US005397013A

United States Patent [19]

Adams et al.

[11] Patent Number: 5,397,013

[45] Date of Patent: * Mar. 14, 1995

[54] ONE-PIECE FITMENT AND TETHERED PLUG WITH TAMPER-EVIDENT MEANS

[75] Inventors: Brian M. Adams, Newark; Daniel Luch, Los Gatos, both of Calif.

[73] Assignee: Portola Packaging, Inc., San Jose, Calif.

[ * ] Notice: The portion of the term of this patent subsequent to Sep. 20, 2011 has been disclaimed.

[21] Appl. No.: 255,563

[22] Filed: Jun. 8, 1994

Related U.S. Application Data

[60] Continuation of Ser. No. 58,872, May 5, 1993, abandoned, which is a division of Ser. No. 823,708, Jan. 21, 1992, Pat. No. 5,271,519, which is a continuation-in-part of Ser. No. 780,774, Oct. 22, 1991, Pat. No. 5,174,465, which is a continuation-in-part of Ser. No. 664,658, Mar. 5, 1991, abandoned.

[51] Int. Cl.[6] ..... B65D 51/18; B65D 41/62

[52] U.S. Cl. ..... 220/256; 220/259; 220/276; 220/307; 220/375; 215/213; 215/225; 229/125.15; 222/541; 222/562; 222/569

[58] Field of Search ..... 215/213, 216, 225, 253, 215/306; 220/270, 254, 256, 259, 266, 276, 307, 375; 222/545, 562, 569, 541, 153, 566; 229/125.15, 125.17

[56] References Cited

U.S. PATENT DOCUMENTS

| | | | |
|---|---|---|---|
| 4,345,690 | 8/1982 | Hopley | 215/216 |
| 4,360,113 | 11/1982 | Luker | 215/216 |
| 4,972,568 | 11/1990 | Schurr | 29/428 |
| 5,133,470 | 7/1992 | Abrams et al. | 215/250 |
| 5,348,182 | 9/1994 | Luch | 220/256 |
| 5,348,183 | 9/1994 | Luch et al. | 220/256 |
| 5,348,184 | 9/1994 | Adams et al. | 220/266 |

*Primary Examiner*—Allan N. Shoap
*Assistant Examiner*—Vanessa Caretto
*Attorney, Agent, or Firm*—Flehr, Hobach, Test, Albritton & Herbert; Julian Caplan

[57] ABSTRACT

A fitment attached around an aperture in a container has a flange from which extends a spout closed by an initially integrally molded externally threaded plug. So long as the fitment and plug are in their original position after molding, the combination is tamper-evident. The plug is moved axially into the spout, with a liquid-tight fit. The plug has an outward extending tab formed with a slot and the fitment has an upward extending finger aligned with the slot in the tab and formed with tangs which lock the finger and tab together as the plug is moved into the spout, thereby making the device tamper-evident. A characteristic of the invention is that a tether interconnects the plug and the upper edge of the spout to prevent disconnection of the one from the other. As a further feature of the invention, an over-size foil seal extends across the bottom of the flange and is welded or otherwise adhered to the bottom of the flange. After assembly the portion of the foil extending outside the flange is welded or otherwise adhered to the carton. This further feature is particularly useful in aseptic packaging. Optionally the lower edge of the plug may be welded to the foil so that when the consumer unscrews the plug the foil under the spout is torn away.

5 Claims, 3 Drawing Sheets

ONE-PIECE FITMENT AND TETHERED PLUG WITH TAMPER-EVIDENT MEANS

CROSS-REFERENCE TO RELATED APPLICATIONS

This is a continuation of application Ser. No. 08/058,872, filed May 5, 1993, now abandoned, which was a division of application Ser. No. 07/823,708, filed Jan. 21, 1992, now U.S. Pat. No. 5,271,519, issued Dec. 21, 1993, which was a continuation-in-part of Ser. No. 780,774, filed Oct. 22, 1991, now U.S. Pat. No. 5, 174,465, issued Dec. 29, 1992, which was a continuation-in-part of Ser. No. 664, 658, filed Mar. 5, 1991, abandoned.

BACKGROUND OF THE INVENTION

1. Field of the Invention

This invention relates to a new and improved spout fitment and a tethered plug-type cap for closing same. More particularly, the invention relates to a fitment which fits around a hole in a panel of a paperboard carton or around a hole in a flexible container, or the like, such as used for packaging liquid products and powders and to a closure for such fitment. The invention is further characterized in that it is tamper-evident. Further, in a modification of the invention, it has container sealing features making it useful in aseptic packaging.

2. Description of Related Art

Generally speaking, prior fitments have spouts with external threads closed by caps with internal threads. Some fitments are used in conjunction with plastic bag containers, the fitment being integrally welded to the plastic bag. Other prior art fitments are attached to a polymer-coated paperboard container such as a gable-top half-gallon container which, optionally, may be lined with foil or plastic. Generally, prior art fitments for paperboard cartons include a thin flange which is welded to the surface of the container. The closure includes a foil seal which seals the mouth of the spout and a liner for the cap which serves a re-sealing function. Attachment to the polymer coated paperboard is accomplished by welding the flange of the spout to the polymer coating. Upon initial removal, the tamper-evident foil seal is removed and discarded.

Fitments of the prior art have a number of deficiencies as compared to the present invention. In the first place, they employ multiple components which increase the cost of the combination very greatly over the simple structures of the present invention. Secondly, the assembly is difficult and involves rotary equipment which is difficult to control in practice and is expensive to install. Thirdly, because of the fact that the prior art spouts are externally threaded, the diameter of the opening in the spout is restricted inasmuch as there is only limited space on the panel of the container on which the flange can be located, thereby reducing the diameter of the fitment flange and correspondingly the internal diameter of the spout. Fourthly, commercially available fitment-closure combinations have no external tamper-evident features, demonstrated, for example, by the internal foil seal of the spout opening of the prior art. Finally, prior fitment-closure combinations have not been adaptable to aseptic packaging.

The openings in prior container panels have been closed off by barrier layers such as shown in U.S. Pat. No. 4,813,578. Such barrier layers are, however, usually part of the laminate of which the container panel is formed. Portions of the plug or cap are secured to the barrier so that when the plug is removed, the barrier is fractured, providing access to the interior of the container. The use of the laminate as the barrier involves manufacturing difficulties which do not occur in accordance with the present invention.

All of the foregoing deficiencies are eliminated in the present invention.

U.S. Pat. No. 3,998,354 discloses an initially one-piece, tethered combination plug and fitment which is stated to be tamper-evident. This reference lacks numerous features of construction of the present invention. It is not disclosed as adaptable to aseptic packaging. It has no tamper-evident feature other than the actual connection between the plug and fitment.

SUMMARY OF THE INVENTION

In accordance with the present invention, a fitment having a spout into which the skirt of a plug fits are provided. The spout and plug skirt are formed with telescoping surfaces so formed that they are liquid-tight when assembled. The plug is tethered to the fitment, preventing the two from being disconnected and also preventing relative rotation between the two.

In one embodiment, a foil disk of greater diameter than the flange of the fitment is attached to the underside of the flange by welding and preferably the foil is also welded to the bottom edge of the plug which fits into the spout of the fitment. The assembled fitment and plug are inserted through the opening in the container panel from the inside of the container and the foil is welded to the underside of the container panel in liquid-tight fashion. This construction is useful in aseptic packaging since the sealing of the foil to the container panel around the opening in the container prevents contamination of the interior of the container after filling.

In one form of the invention, wherein the interior of the spout and the exterior of the plug skirt have an interference or liquid-tight fit, the finger extending up from the spout is received in an aperture in a flange of the plug, thereby preventing removal of the assembled plug and fitment so long as the finger remains intact.

Initially, the plug and fitment are preferably molded in a single mold and the two parts are connected together by frangible gates joining the plug skirt and the upper edge of the fitment spout. Either in the final stage of the molding process or separately, the plug is depressed relative to the fitment by a straight axial push. At the same time the parts are collapsed, the finger of the fitment is inserted into a socket in the plug. In assembled position, because of the tether between plug and fitment the plug cannot be removed without giving evidence of tampering. The fitment flange is then attached to the container and the container is filled. The foil seal is welded to the container panel around the outside of the fitment flange.

In one form of the invention, the initial gate between the plug and spout is left intact until the parts are separated by the consumer. The initial intact gate material is thus a tamper-evident feature.

In another form of the invention the plug is inserted in the spout prior to installation on the container. A tamper-evident feature is used, namely a finger extending up from the upper edge of the spout fitting through a slot in the thumb tab of the plug. The connection of the finger to the spout is frangible, permitting the plug to be removed.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
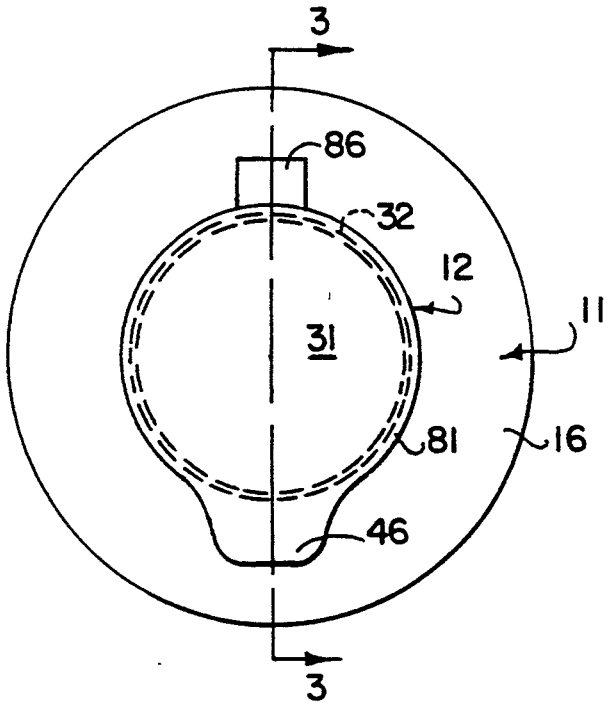
FIG. 1 is a top plan view of the plug and fitment.
Figure 2:
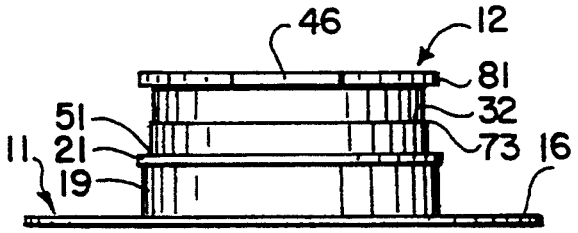
FIG. 2 is a side elevational view of the plug and fitment prior to assembly.
Figure 3:
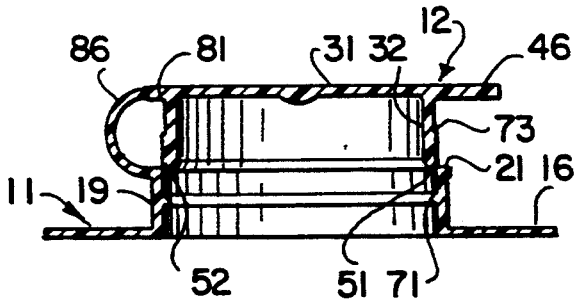
FIG. 3 is a sectional view taken substantially along the line 3—3 of FIG. 1.
Figure 4:
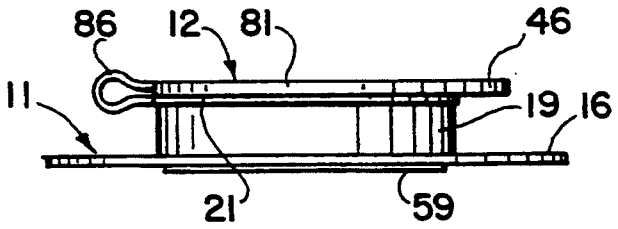
FIG. 4 is a side elevational view of the plug inserted in the fitment spout.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

In the form of the invention shown in FIGS. 1–4, there are a fitment portion 11 and a plug or cap portion 12.

Fitment portion 11 has an annular flange 16 which is attached to the container panel 13 surrounding the hole 14 therein. Various means may be used to join the flange 16 to the panel 13. Welding the flange to the panel is a preferred choice in the present invention.

Projecting upward from the inside of the flange 16 is a spout 19 having a top edge 21. An internal seal bead 71 is formed in the spout 19.

Plug 12 has a top disk 31 from which depends skirt 32, which is formed with external shoulder 73 approximately midway of the length of skirt 32. A narrow peripheral flange 81 extends outward beyond skirt 32. A tether band 86 interconnects flange 81 and the upper end flange 21 of spout 19, serving as a hinge. Thumb tab 46 extends from flange 81 opposite tether band 86.

The plug portion 12 and fitment portion 11 are initially connected together at frangible line of weakness 51 joining the edge of skirt 32 to the top edge 21 of spout 19. If the flange 16 is welded to panel 13, the combination is tamper-evident so long as the line of weakness 51 is intact.

Alternatively, either during a final ejection stage of the molding process or subsequently, the plug 12 is pushed down so that the skirt 32 slips inside the spout 19.

Figure 5:
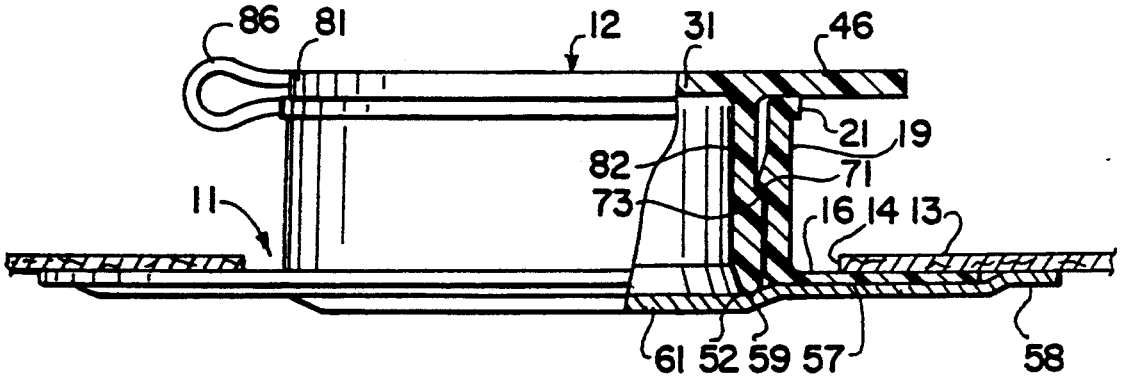
FIG. 5 is a sectional view showing a foil seal making the assembly aseptic.
Figure 6:
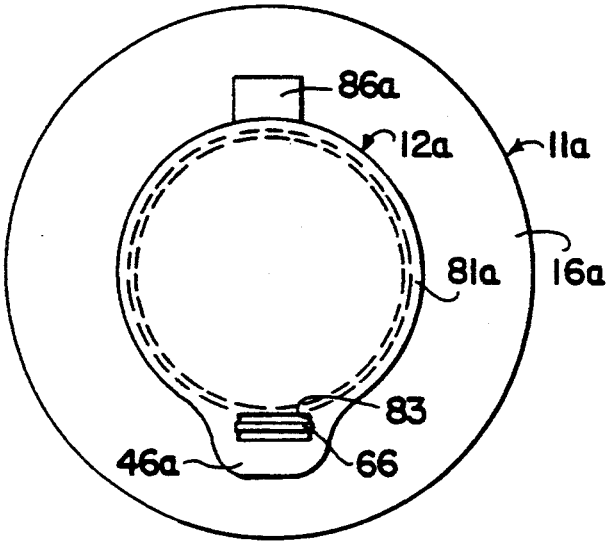
FIGS. 6–10 are views similar to FIGS. 1–5 of a modification.
Figure 7:
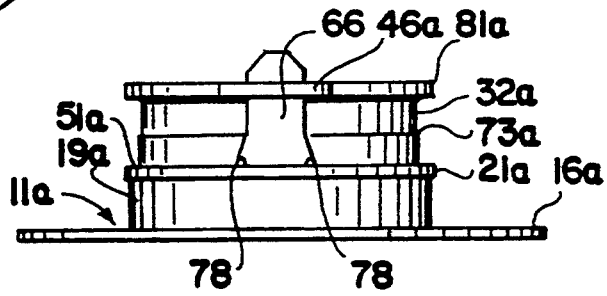
Figure 8:
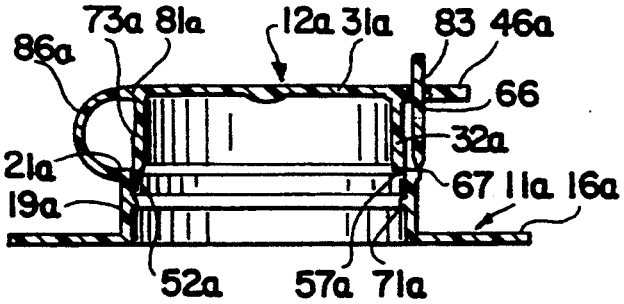
Figure 9:
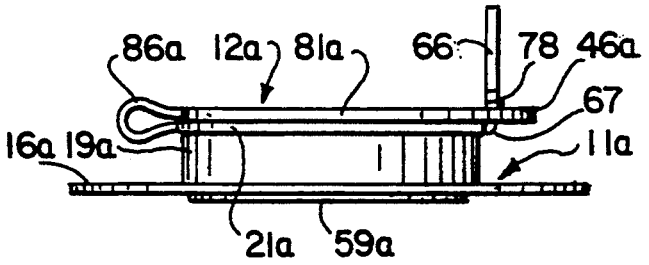
Figure 10:
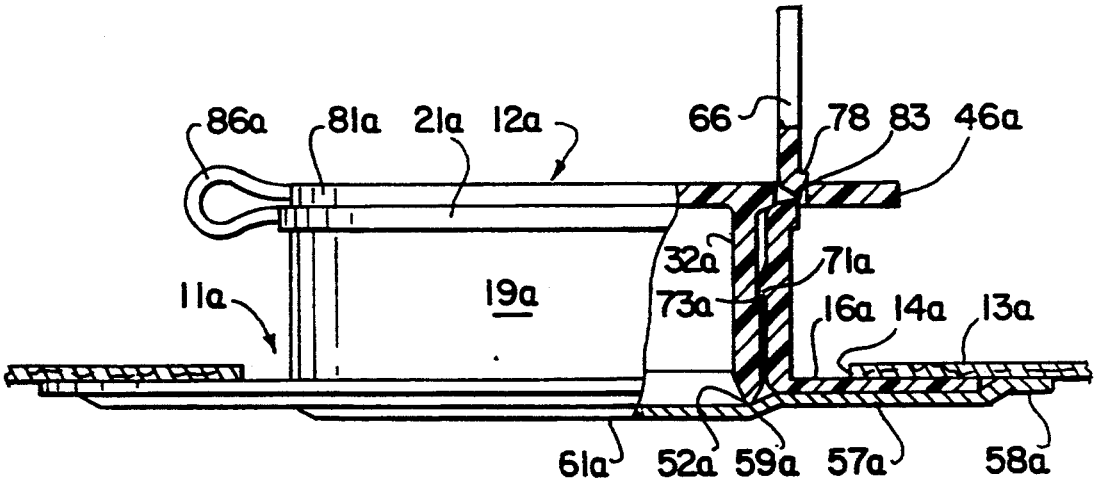

Directing attention to the structures shown in FIG. 5, a foil disk 61 having a diameter greater than that of the flange 16 is initially secured to the underside of flange 16 in a circular pattern by means of a weld 57 or other means of attachment. Optionally, a circular weld 59 may be formed between the foil disk 61 and the bottom edge 52 of the plug skirt 32. The assembled fitment 11 and plug 12 are installed in the container by inserting through the opening 14 in the panel 13. The outer portion of the flange 16 engages the underside of the panel 13 surrounding the opening 14. A weld 58 is formed between the foil 61 and the underside of the panel 13. It will be observed that an aseptic container may be provided since the opening 14 is completely sealed by the disk 61 which also seals the opening in the flange 16. Hence if the container and the contents are sterile when the container is filled and the container is sealed in sterile fashion, an aseptic package results.

Cap 12, of course, serves as a reclosure cap until the contents of the container are consumed. Interfitting of bead 71 and shoulder 73 prevents unintentional separation of the plug and fitment.

When the plug 12 is lifted, the weld 59 to the bottom edge 52 of the skirt 32 causes fracture of the foil 61. The welding of the foil 61 to the bottom edge 52 is optional. Thus if the foil 61 is not removed from the area within the opening of the annular flange 16 when the plug 12 is removed, the presence of the foil is tamper evidence. The consumer may obtain access to the interior of the container by puncturing the foil 61 with a straw or a finger or an instrument such as a knife.

Directing attention now to the form of the invention shown in FIGS. 6–10, finger 66 extends vertically upward and is joined at its lower end by juncture 67 to the top edge **21*a* of spout 19*a*. A slot 83 is formed in lift tab 46*a*. Finger 66 projects through slot 83. Because of tether band 86*a*, plug 12*a* cannot be removed so long as finger 66 is intact. Finger 66 preferably has flexible outward extending tangs 78. When assembled the tangs 78 are above tab 46*a*, preventing removal of plug 12*a* without first removing finger 66** and giving evidence of tampering.

In many respects, the structure of FIGS. 6–10 resembles that of the preceding modification and the same reference numerals followed by the subscript "a" are used to indicate corresponding elements.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed:

1. In combination, an intermediate product comprising a fitment and a plug therefor shaped to seal around an aperture in a container, said fitment comprising an annular flange shaped to fit on one side of said container and around said aperture, a hole in said flange for alignment with said aperture, a spout having an inside wall having an upper edge upstanding relative to said flange surrounding said hole, and first attachment means on said inside wall, said plug having a top, a skirt having an exterior surface depending from said top, second attachment means on said exterior surface cooperable with said first attachment means to detachably secure said plug to said fitment with said skirt disposed inside said spout, said plug and said spout having a common central axis, in which said plug is integrally molded with said fitment and a lower portion of said exterior surface of said skirt and said upper edge of said spout are frangibly joined together in alignment on said common axis along a line of weakness, said flange comprising a thin member extending outward relative to said spout, first tamper-evidencing means integral with said fitment and second tamper-evidencing means integral with said plug, said first tamper-evidencing means comprising a finger attached to and extending upward from said fitment parallel to said central axis and said second tamper-evidencing means comprising a tab extending outwardly of said plug formed with an aperture to receive said finger, said finger and said aperture being aligned parallel to said common axis, a portion of said finger extending through said aperture while said line of weakness is intact, said tamper-evidencing means being interengagable by axial movement of said plug relative to said fitment along said common axis without turning said plug and fitment relative to each other, said line of weakness fracturing by said movement of said plug toward said fitment along said common axis and said finger moving through said aperture and said plug being restrained from removal from said spout after said axial movement without displacing at least one of said tamper-evidencing means, said first tamper-evidencing means being frangibly attached to said fitment.

2. The combination of claim 1 in which said first tamper-evidencing means further comprises at least one outward extending tang on said finger positioned to rest above said tab when said plug has been moved toward said fitment to the full extent of its movement and said finger extends: through said aperture to the full extent of its movement.

3. The combination of claim 1 in which said finger is rectangular in cross-section and has a width, said width of said finger in rectangular cross-section being positioned parallel to a horizontal tangent to said spout.

4. The combination of claim 1 in which said spout has an upper edge and said finger extends up from said upper edge of said spout.

5. The combination of claim 1 which further comprises a tether interconnecting said plug and said fitment.

* * * * *